US007774906B2

(12) United States Patent
Takazawa

(10) Patent No.: US 7,774,906 B2
(45) Date of Patent: Aug. 17, 2010

(54) SLIDE FASTENER

(75) Inventor: Shigeyoshi Takazawa, Runcorn (GB)

(73) Assignee: YKK Corporation, Tokyo (JP)

( * ) Notice: Subject to any disclaimer, the term of this patent is extended or adjusted under 35 U.S.C. 154(b) by 763 days.

(21) Appl. No.: 11/710,779

(22) Filed: Feb. 26, 2007

(65) Prior Publication Data

US 2007/0204439 A1 Sep. 6, 2007

(30) Foreign Application Priority Data

Mar. 2, 2006 (GB) ..... 0604213.9

(51) Int. Cl.
*A44B 19/36* (2006.01)
*A44B 19/38* (2006.01)

(52) U.S. Cl. ..... 24/436; 24/405; 24/433

(58) Field of Classification Search ..... 24/388, 24/439, 436, 433, 405
See application file for complete search history.

(56) References Cited

U.S. PATENT DOCUMENTS 2,422,091 A * 6/1947 Gould ..... 24/436
2,441,007 A 5/1948 Carlile
2,601,710 A * 7/1952 Moehler ..... 24/436
2,625,726 A * 1/1953 Austin ..... 24/433
2,894,305 A 7/1959 Brown
4,878,275 A 11/1989 Kazui et al.

FOREIGN PATENT DOCUMENTS

| | | |
|---|---|---|
| EP | 1516553 | 3/2005 |
| GB | 1 519 340 A | 7/1978 |
| GB | 1519340 | 7/1978 |
| JP | 41-22065 | 12/1941 |
| TW | M245806 | 10/2004 |

OTHER PUBLICATIONS

European Search Report for corresponding European Patent Application No. 07250880.7, dated Feb. 5, 2009.

* cited by examiner

*Primary Examiner*—Robert J Sandy
(74) *Attorney, Agent, or Firm*—Alston & Bird LLP

(57) ABSTRACT

A slide fastener (1) has a releasing end stop (15) having a shoulder (27) which impedes movement of the releasing end stop (15) through the channel (47) of the slider (35). The releasing end stop (15) is pivotable relative to the opposed coupling element (11) to allow movement of the releasing end stop (15) through the channel (47) of the slider (35) when additional force is applied to the slider (35). With this construction, the releasing end stop (15) enjoys a longer life span. Furthermore it is advantageously possible to use the same material for the top end stop (15) as for the coupling elements (11), so that the manufacturing process will be much simplified.

10 Claims, 5 Drawing Sheets

SLIDE FASTENER

CROSS-REFERENCES TO RELATED APPLICATIONS

The entire disclosure of British Patent Application Number GB0604213.9 filed on Mar. 2, 2006 is incorporated herein by reference in its entirety.

BACKGROUND

1. Field of the Invention

This invention relates to a slide fastener. In particular it relates to a slide fastener in which the slider can be moved past an end stop for stopping the sliding movement of the slider in order to allow opening of the slide fastener.

2. Description of the Related Art

Conventional slide fasteners comprise a pair of stringers, each stringer being comprised of a tape and coupling elements, and a slider which can be moved along the coupling elements of the stringers to engage and disengage the coupling elements. A top end stop is placed at the upper end of one or both of the stringers to prevent the slider from moving beyond the coupling elements on one or both stringers, which would otherwise allow unpeeling of the coupling elements and separation of the stringers. In certain situations it is advantageous that the slider can be moved beyond a top end stop on one of the stringers by applying additional force, so that the stringers can be quickly separated. Such a top end stop is sometimes called a "top open" or a releasing end stop.

In normal operation, a releasing end stop impedes further upward movement of the slider, to maintain the coupling elements in an engaged state. If an increased forced is applied to the slider to move the slider upwards, the slider is forced past the releasing end stop to allow quick opening of the slide fastener by unpeeling the engaged elements below the slider. In this way, the releasing end stop can be said to impede, but not prevent, passage of the slide fastener. Preferably the releasing end stop is provided on one tape only. The elements on the other tape extend beyond the level of the releasing end stop to hold the slider on the other tape. After the tapes are separated, the slider is slid down to the bottom of the other tape to allow the fastener to be refastened in the usual way.

One such arrangement is shown in U.S. Pat. No. 2,894,305. The releasing end stop has a spring member which abuts cooperating elements on the opposing tape to prevent movement of the slider past the releasing end stop. When additional force is applied to the slider, the spring yields to allow the end stop and the cooperating elements to close together and allow the slider to slide past the releasing end stop.

In GB-A-1 519 340 describes a slide fastener having a pair of cooperating releasing stops respectively mounted on opposed stringers. One of the end stops has a substantially annular shape, such that a portion of the top end stop can be deflected inwards to compress the top end stop when the top end stops are pushed together by the neck of the slider. A similar arrangement is used in Japanese publication 41-22065 and Taiwanese publication M245806 which each describe integrally formed releasing end stops having a deflectable or deformable portion which allows the end stop to be compressed when a suitable force is applied by the slider to the end stop.

Typically, a releasing end stop is provided in a slide fastener having injection moulded plastics elements, such as are manufactured by the current applicant under the trade mark VISLON. Suitable materials are preferably rigid and hard-wearing so as to prolong the life of the coupling elements which are subject to the repeated sliding movement of the slider. It is preferable to use the same material for the top end stop as for the coupling elements, so as to simplify the manufacturing process. However, when made of relatively rigid material, the deformable portion must be relatively thin to allow it to deform, but it is still inherently hard or inflexible and thus is prone to breaking.

It is an object of this invention to provide a releasing end stop which overcomes these problems.

SUMMARY

In accordance with a first aspect of the invention there is provided a slide fastener comprising a pair of first and second stringers each including a tape and a row of coupling elements mounted on a respective longitudinal edge thereof, and a slider having flanges defining therebetween a channel through which the coupling elements pass and adapted to reciprocally move along the rows of the coupling elements, the first stringer including a releasing end stop adapted to engage with the flanges to impede movement of the releasing end stop through the slider, wherein the releasing end stop is pivotable relative to the opposed coupling element to allow movement of the releasing end stop through the slider when additional force is applied to the slider. With such construction, the releasing end stop can be made of rigid and hard-wearing materials suitable for repeated operation of the slide fastener. Therefore, the likelihood of the releasing end stop being damaged during operation is reduced. Moreover, it is possible to use the same materials for the top end stop as for the coupling elements, so that the manufacturing process will be much simplified.

Other aspects and features of the invention will be apparent from the following description and the accompanying claims.

DESCRIPTION OF THE DRAWINGS

The invention will be further described by way of example with reference to the accompanying drawings in which.

DETAILED DESCRIPTION

The present invention is closely described in accordance with preferred embodiments in conjunction with drawings attached hereto.

Figure 1:
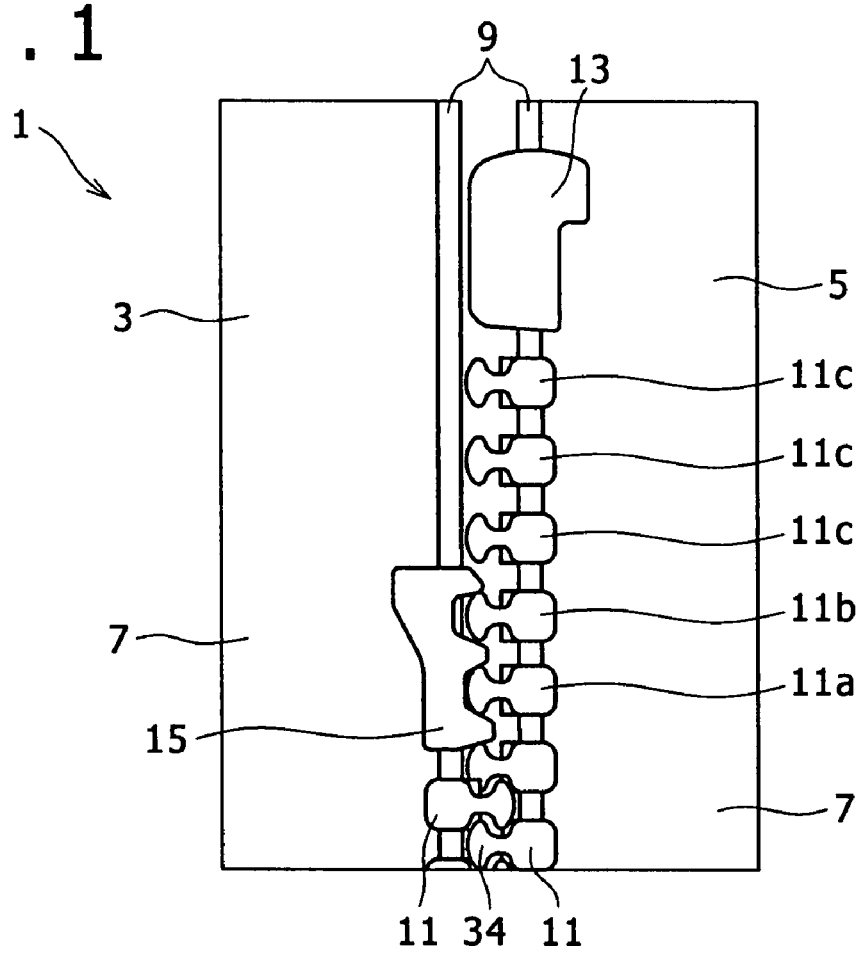
FIG. 1 is a plan view of a top portion of a slide fastener including a release end stop, forming an embodiment of the invention with a slider thereof removed.

FIG. 1 is a plan view of a top portion of a slide fastener forming an embodiment of the present invention with a slider thereof removed. The slide fastener 1 of FIG. 1 comprises a first stringer 3, a second stringer 5 and a slider (not shown in FIG. 1). Each of the stringers 3, 5 is comprised of a tape 7 having a cord 9 along its longitudinal edge. The cord 9 is bulged outwardly perpendicularly of the plane of the tape 7. The coupling elements 11 are clamping mounted on the bulged cord 9.

In this embodiment the coupling elements 11 are moulded onto the cord 9 of the stringers 3, 5 and are formed of a suitable thermoplastic material, although metal elements may be used. The bottom end (not shown) of the stringers 3, 5 of the slide fastener 1 comprises a receiving box and insert pin arrangement mounted on the respective tapes 7 to enable the stringers 3, 5 to be initially coupled together, as is known in the art. The slider is slidably mounted along the coupling elements 11 of the second stringer 5 to move between the receiving box (not shown) adjoining the bottom of the row of coupling elements 11 on the second stringer 5 and a conventional top end stop 13 adjoining the top end of the respective row of coupling elements 11. The slide fastener is a separable fastener in which the first and second stringers 3, 5 are completely separable. It will be appreciated that the first and second stringers 3, 5 may be permanently joined together at the bottom, as known in the art.

A releasing end stop 15 is mounted adjoining to the top of the row of coupling elements 11 of the first stringer 3. The releasing end stop 15 is clampingly attached to the cord 9 of the tape 7 just as the coupling elements 11. The releasing end stop 15 is made preferably of the same material as the coupling elements 11, although a plastic releasing element may be preferred even when the coupling elements are of metal. There are more coupling elements 11 on the second stringer 5 than on the first stringer 3 so that there are a number of coupling elements 11 provided on the second stringer 5 above the modified top end stop 15 when the slide fastener 1 is closed, as can be seen from FIG. 1.

Figure 2A:
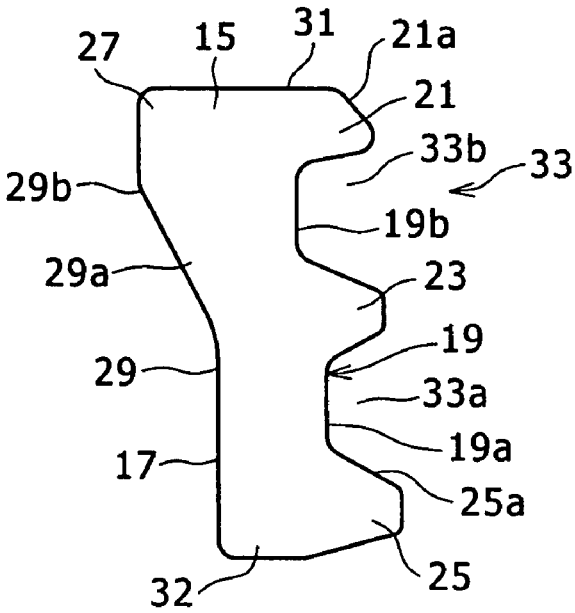
FIG. 2*a* is a plan view of the releasing end stop of the slide fastener of FIG. 1.
Figure 2B:
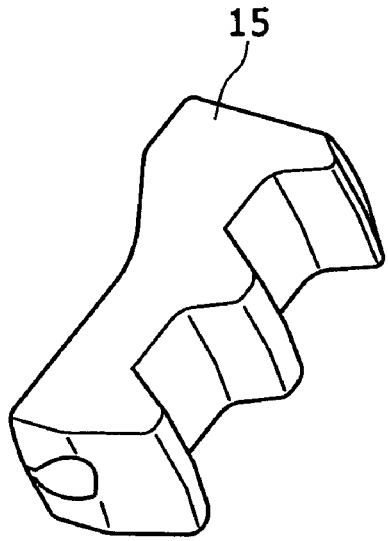
FIG. 2*b* is a perspective view of the releasing end stop of FIG. 2*a;*

The releasing end stop 15 is shown in FIGS. 2*a* and 2*b* and will now be described in more detail. The releasing end stop 15 comprises a solid, elongate body portion 17, which has a plurality of protrusions 21, 23, 25 provided and spaced at predetermined intervals on a first side 19 of the body portion 17 and recesses 33 formed between the protrusions 21, 23, 25. Furthermore, the elongate body portion 17 has a shoulder 27 provided on the second side 29 of the body portion 17 which is opposed to the first side 19 so as to project laterally from the second side 29. The releasing end stop 15 has a substantially constant thickness, which is the same as the thickness as the elements 11.

The first protrusion 21 provided on the first side 19 of the body portion 17 is disposed at the upper end of the body portion 17, while the second protrusion 25 is disposed at the lower end 32 of the body portion 17. Furthermore, the third protrusion 23 is disposed in the middle of the first side 19 of the body portion 17. With the protrusions 21, 25, 23 thus arranged, the recess 33 is divided into the first recess 33*a* formed between the protrusions 25 and 23 and the second recess 33*b* formed between the protrusions 21 and 23. The shoulder 27 provided on the second side 29 of the body portion 17 is at the same end 31 or the upper end of the body portion 17 as the protrusion 21 on the first side 19 of the body portion 17. The shoulder 27 has a shoulder surface 29*b* formed at the proximal side and a sloping outer side surface 29*a* extending between the shoulder surface 29*b* and the second side 29 and slanting from the second side 29 toward the upper end 31 of the body portion 17.

When the releasing end stop 15 is mounted on the stringer 3 of the slide fastener 1, as shown in FIG. 1, the first side 19 of the body portion 17 on which the protrusions 21, 23, 25 are formed faces outwards, i.e., it faces the opposed stringer 5, and the second side 29 of the body portion 17 faces inwards, i.e., in the direction opposed to the direction in which the first side 29 faces. Recesses 33*a*, 33*b* between the protrusions 21, 23 and the protrusions 23, 25 are of the order of the size of a head 34 of the coupling elements 11 of the opposed second stringer 5, so that the heads 34 of the coupling elements 11*a*, 11*b* can be received in the recesses 33*a*, 33*b* formed between the protrusions 21, 23, 25, as shown in FIG. 1.

It will be appreciated that the terms "top" and "bottom", and "upwards" and "downwards" relate to the slide fastener per se and are descriptive terms as generally used in the art and for ease of description. The fastener itself may be used in any orientation.

The first side 19 of the body portion 17 between the protrusions 23 and 25, i.e. the bottom 19*a* of the recess 33*a*, projects beyond the first side 19 of the body portion 17 between the protrusions 21, 23, i.e. the bottom 19*b* of the recess 33*b*, in the direction of the opposed elements 11. Thus, as seen in FIG. 1, the head of the opposing element 11*a* opposed to the bottom 19*a* fits snugly into the recess 33*a* to abut or lie close to the bottom 19*a*. With the cord 9 supporting the coupling element on the tape 7 being substantially straight, the head of the opposing element 11*b* opposed to the bottom 19*b* is received in the recess 33*b* but spaced from the bottom 19*b*, as seen in FIG. 1. Also as seen in FIG. 1, in this particular embodiment, the cord 9 of the stringer 3 is exposed between the protrusions 21, 23 at the bottom 19*b*.

Figure 3:
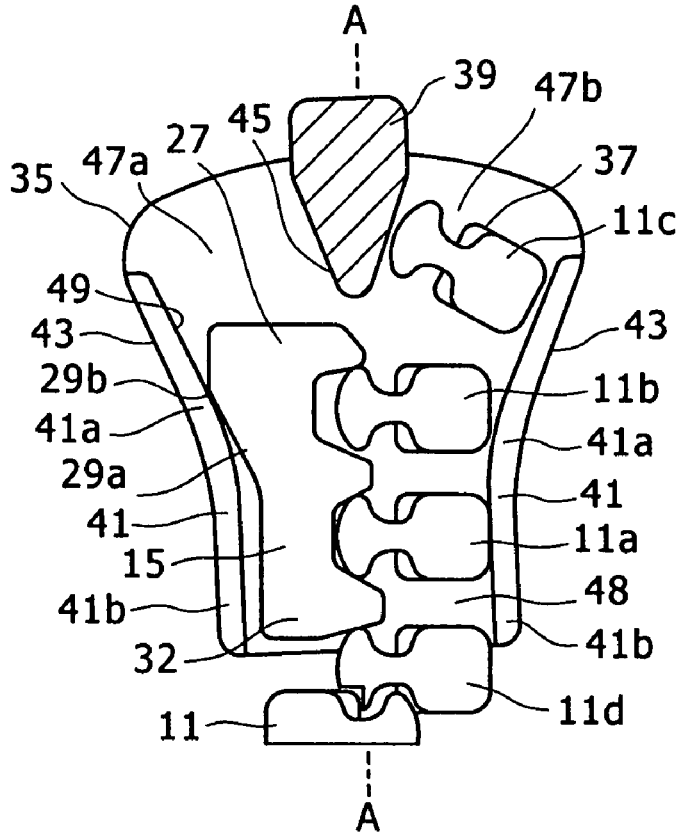
FIG. 3 is a partial, cut-away view of the embodiment of FIG. 1 showing the releasing top end stop and coupling elements within the channel of a slider when the releasing end stop impedes upward movement of the slider, i.e. in the direction of closing.

FIG. 3 is a cut-away view of a slider 35 mounted on slide fastener 1. The tapes 7 and cords 9 and the upper wing of the slider 35 which carries the slider puller intended to be gripped to move the slider have been omitted. The slider 3 is shown in the uppermost position when the releasing end stop 15 impedes the slider 35 from further upward movement along the slide fastener 1. The slider 35 is comprised of a pair of upper and lower wings 37 which are vertically spaced and are joined at their respective ends by a dividing wall or "diamond" 39. Flanges 41 extend from the edges 43 of each wing 37 towards the opposed wing 37. Flanges 41 and the dividing wall 39 define a bifurcated or Y-shaped channel 47 through which the coupling elements 11 move as the slider 35 is moved along the rows of coupling elements 11. The tapes 7 extend outward from the slider 35 between the opposed flanges 41 of the upper and lower wings 37.

As is well known in the art, the channel 47 is formed through the slider from its front end to the rear end, and comprises two channel portions 47*a*, 47*b* disposed on the opposed sides of the dividing wall 39 and a neck 48 formed at the rear end of the slider distal of the dividing wall 39 and passing between the opposed flanges 41. The channel 47 converges in the region of the neck 48. The dividing wall 39 has a wedge portion 39*a* which is decreased in width from the front end towards the rear end. The opposed flanges 41 each comprise an arcuate flange region 41*a* slanting arcuately inward or toward the corresponding region of the other flange 41 downwards and a rectilinear flange region 41*b* which is disposed between the arcuate flange portion 41*a* and the rear end of the slider 35 and is parallel with the corresponding region of the other flange 41 longitudinally of the slider 35.

As the slider 35 moves up the rows of elements 11, in the direction of closing the fastener 1, the coupling elements 11 of each stringer 3, 5 pass the sides of the diamond or the dividing wall 39 and enter the neck region 48 where they are urged into coupling relationship, the heads 34 of the opposed elements 11 interlocking. As known in the art, for the slider 35 to work efficiently the cords 9 at the edge of each tape carrying the respective elements must flex sufficiently to enlarge the gap between adjacent element heads for the opposed element head to be urged between them. Thus, the channel 47 is bifurcated and a smooth transition is provided from the channels 47*a*, 47*b* to the neck region 48 by an arcuate flange region 41*a* of the flange 41 which is closer to the rear end of the slider 35 than to the dividing wall 39. The elements 11 slide over the inner surface 49 of the flanges 41 as the slider is raised.

As can be seen from FIG. 3, when the lower end 32 of the releasing end stop 15 is in the neck region 48 of the slider 35, the heads 34 of the opposed coupling elements 11*a*, 11*b* on the second stringer 5 engage in the recesses 33*a*, 33*b* between the protrusions 21, 23, 25 on the first side 19 of the body portion 17 of the releasing end stop 15, as the releasing end stop 15 and the coupling elements 11*a*, 11*b* are pushed towards each other by the flanges 41 of the slider 35 at the neck region 48. Thus, the releasing end stop 15 is oriented by engagement between the adjacent arcuate flange portion 41*a* in the region of the neck region 48 and the opposite element 11*a* in the neck region 48.

The shoulder 27 on the second side 29 of the body portion 17 of the top end stop 15 abuts the inner wall 49 of the flanges 41 where the channel 47 starts to narrow to form the neck 48, at the arcuate flange region 41*a* which is closer to the rear end of the slider 35 than the dividing wall 39. It can be seen that because of the widening of the releasing end stop 15 at the shoulder 27, the combined width of the releasing end stop 15 and the opposed element 11*b* is greater than the width of the neck 48 and so there is not sufficient room for the end stop and coupling element 11*b* to pass beyond the arcuate region 41*a* of the flange 41 into the neck 48, while the releasing end stop 15 is parallel with the longitudinal axis A-A of the slider 35.

Figure 4:
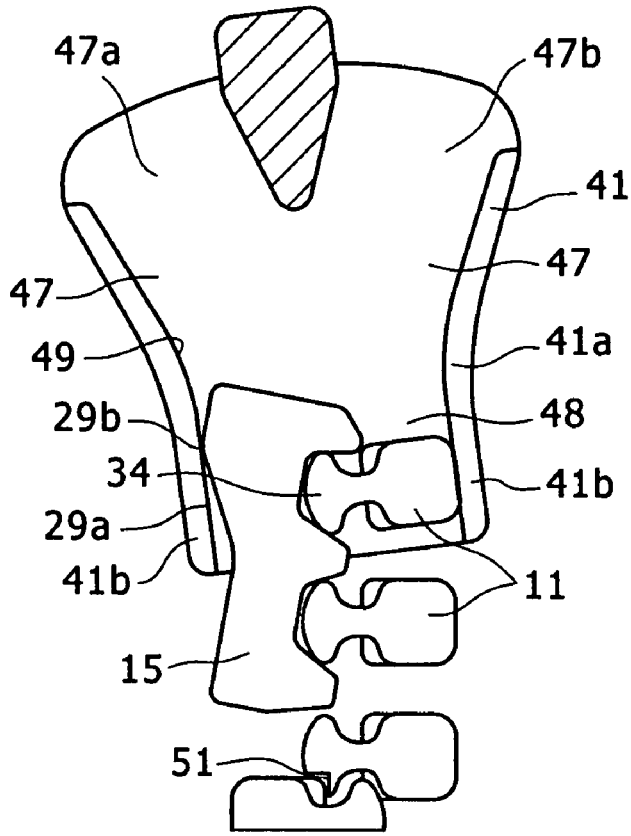
FIG. 4 is a partial, cut-away view of the embodiment of FIG. 1 showing the releasing end stop and coupling elements within the channel of the slider when the slider is forced past the releasing end stop.
Figure 5A:
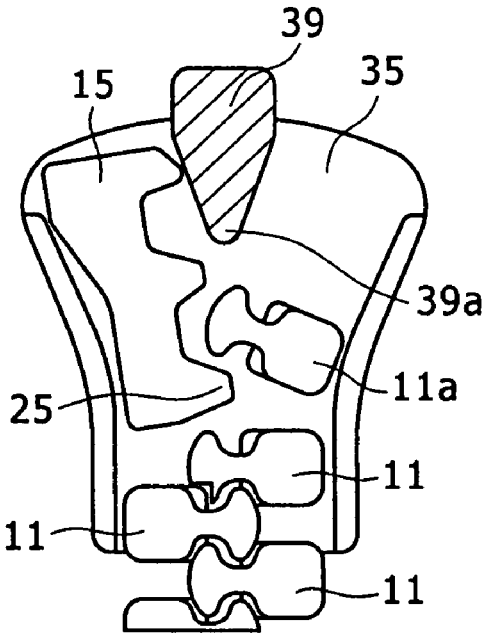
FIGS. 5*a* to 5*d* show a partial, cut-away view of the embodiment of FIG. 1 showing the slider, releasing end stop and coupling elements when the slider is moved down the slide fastener, i.e. in the direction of opening.
Figure 5B:
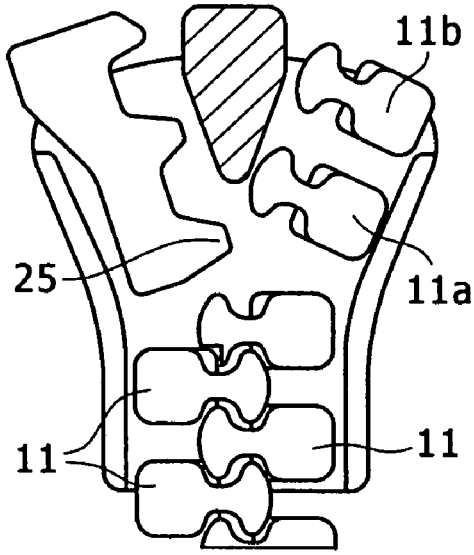
Figure 5C:
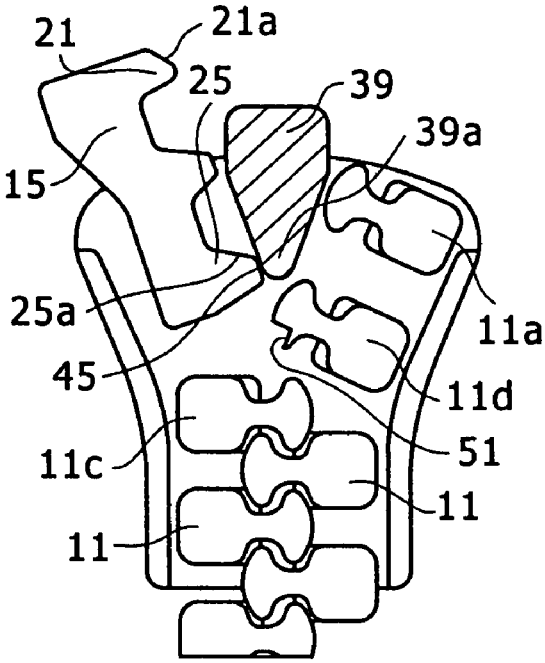
Figure 5D:
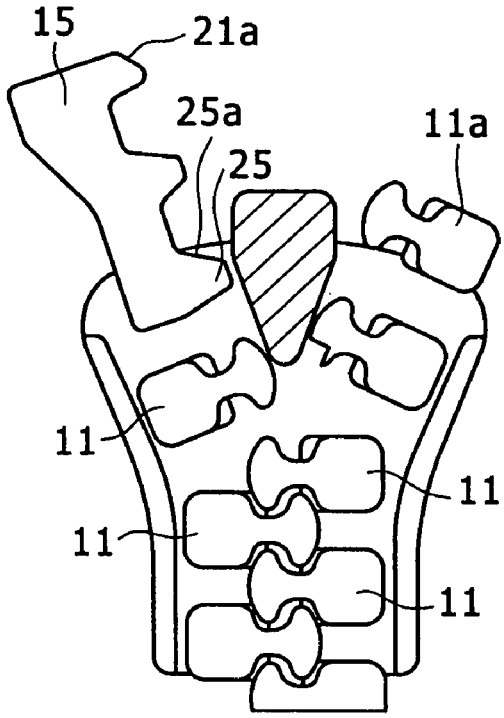

FIG. 4 shows the position of the releasing end stop 15 and the opposed coupling elements 11*a*, 11*b* when an increased force is applied to the slider 35 to move the slider 35 upwards to force it past the releasing end stop 15. When an increased force is applied to the slider 35 the outer side surface 29*a* of the shoulder 27 rides along the inner surface 49 of the flange 41 causing the upper end of the releasing end stop to move further towards the slider axis A-A and the releasing end stop 15 rotates in the plane of the tape 7. This rotation of the releasing end stop 15 is effected by the releasing end stop 15 pivoting about the head 34 of the coupling element 11*a* on the second stringer 5 received within the recess 33*a*. The releasing end stop 15 continues to pivot and change its posture until the shoulder 27 clears the arcuate flange portion 41*a* and the lower end of the releasing end stop 15 moves through the neck 48 and out of the slider.

As the releasing end stop 15 rotates, the combined width of the releasing end stop 15 and the coupling element 11*b* as measured transverse to the axis A-A of the slider 35 is reduced. Thus, as the releasing end stop 15 rotates out of parallel with the slider axis A-A, it can be eased through the neck 48 of the slider 35, so that the slider can be pulled over the releasing end stop 15 and the opposed coupling elements 11*a*, 11*b*, and hence the releasing end stop 15 can pass through the channel 47 of the slider 35. As seen in FIG. 4, the head 34 of the coupling element 11*b* which is in the recess 33*b* between the protrusions 21, 23 of the top end stop 15 is pushed further into the recess 33*b*, so that it abuts the first side 19 of the releasing end stop 15 (or the cord 9, in FIG. 1) as the top end stop 15 rotates in the plane of the tape 7.

The force required to move the slider 35 over the releasing end stop 15 and the opposed coupling elements 11 will depend on the size of the shoulder 27 and also the resilience of the tape 7 and cord 9 on the edge of the first stringer 3. The resilience of the tape 7 and the cord 9 causes the inner surface 49 of the flange 41 bias the releasing end stop 15 into the position shown in FIG. 4. The ability of the releasing end stop 15 to be released through the neck region 48 of the slider 35 relies on the flexibility of the tape 7 and the cord 9 to allow the end stop 15 to rotate within the slider, rather than the compressibility of the top end stop 15. This means that the releasing end stop 15 can be made of a rigid, hardwearing material to suit the repeated operation of the slide fastener. Hence, the likelihood of the releasing end stop 15 being damaged during operation is reduced.

As can be seen from FIG. 1, in this embodiment a portion of the cord 9 protrudes from the first side 19 of the body portion 17 of the top end stop 15 between the protrusions 21, 23. This protruding portion of the cord 9 is compressed when the head 34 of the opposed coupling element 11*b* is pushed into the recess 33*b* between the protrusions 21, 23, as can be seen in FIG. 4, and the resilience of the cord 9 at this position further provides a biasing force on the opposed element 11. In other embodiments the cord 9 is not exposed at this position between the protrusions 21, 23 but the cord 9 is encased within the releasing end stop 15 at the bottom 19*b*.

Three additional elements 11*c* are provided on the second stringer 5 above the coupling element 11*b* to retain the slider 35 on the tape 7 of the second stringer 5 and facilitate continued upward movement of the slider 35 beyond the releasing end stop 15. Preferably the releasing end stop 15 is positioned so that the slider 35 can clear the releasing end stop 15 by the length of a coupling element (measured in the longitudinal direction of the cord 9). In this case this is provided by the three elements 11*c* and the top end stop 13 attached to the upper end of the second stringer 5 in adjoining relation to the coupling elements 11*c*. To ensure that the first stringer 3 is readily decoupled from the slider 35, the cord 9 on the first stringer 3 above the releasing end stop 15 may be flattened or removed to allow the tape 7 to be readily pulled from the space between the opposed flanges 41 of the upper and lower wings 37 of the slider 35.

Referring briefly to FIG. 3, the shoulder of the coupling element 11 adjoining the lower end 32 of the releasing end stop 15 is modified to facilitate moulding of the end stop and so the head 34 of the opposed element 11*d* on the second stringer 5 which is to engage that coupling element 11 has a cut away 51 formed therein to prevent interference with the shoulder of the coupling element 11.

FIGS. 5*a* to 5*d* show the position of the releasing top end stop 15 within the slider 35 as the slide fastener 1 is opened, i.e. as the slider 35 moves down the stringers 3, 5 from the position shown in FIG. 3. The bifurcated channel 47 defined by the flanges 41 of the slider 35 and the diamond or the dividing wall 39 of the slider 35 guide the releasing top end stop 15 and the couplings elements 11*a*, 11*b* so as to peel apart the coupling elements 11 that enter the bottom of the slider 35, as the coupling elements 11 move further into the channel 47.

From FIG. 1, it can be seen that the protrusion 25 on the releasing end stop 15 does not project outwards from the cord 9 as far as the head 34 of the adjoining coupling elements 11. In order to ensure a smooth passage of the adjoining coupling elements 11 through the bifurcated channel 47 during opening of the fastener, the bottom protrusion 25 on the releasing end stop 15 must extend sufficiently so that when it abuts the side wall 45 of the dividing wall 39, the releasing top end stop 15 and the opposed coupling element 11 on the other stringer 5 are sufficiently separated from each other with the wedge portion 39*a* of the dividing wall 39 interposed therebetween, so that the coupling elements 11 below are peeled apart.

It will be appreciated that the user may want to reverse the direction of the slider or pull it down after he has pulled up the slider 35 so that the movement of the slider 35 is impeded by the releasing end stop 15, as seen in FIG. 3. The protrusion 21 provided on the upper end 31 of the releasing end stop 15 and the protrusion 25 provided on the lower end 32 thereof, in particular, are shaped to ensure smooth operation of the slider when the slider 35 moves downwards to open the slide fastener 1, as well as when the slider 35 moves upwards to close it. Thus, the protrusions 21, 25 are tapered at their ends to provide sloping engagement surfaces 21*a*, 25*a* which will slide over the wedge portion 39*a* of the dividing wall 39 to assist the movement of the dividing wall 39 past the releasing end stop 15 in the downwards, opening direction.

The protrusions 21, 25 has the sloping engagement surfaces 21*a*, 25*a* formed, to thus taper towards their ends. The sloping engagement surface 21*a* of the protrusions 21 is disposed adjacent to the upper end 31 of the releasing end stop 15 and the sloping engagement surface 25*a* of the protrusion 25 is disposed adjacent to the lower end 32 of the releasing end stop 15. It will be seen that the sloping engagement surface 21*a* of the protrusion 21 slopes more steeply to thus cross the axis A-A of the slider 35 at a smaller angle than the sloping engaging surface 25*a* of the protrusion 25. An angle of about 30 to 50 degrees relative to the cord 9 and preferably about 35 to 45 degrees, more preferably about 40 degrees is used, which is similar to the angle presented by the apex of the head 34 of a coupling element 11.

Figure 6A:
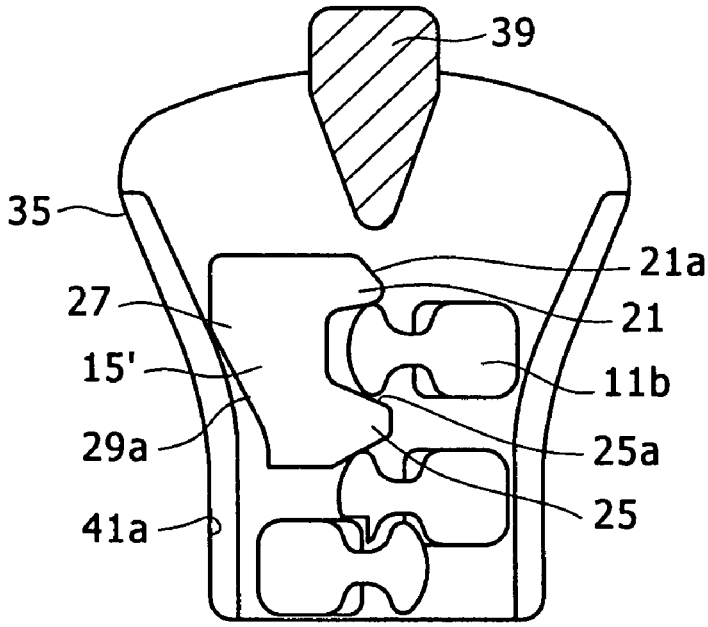
FIGS. 6*a* and 6*b* show a modification of the embodiment of FIGS. 1 to 5 with a releasing end stop of shorter length.
Figure 6B:
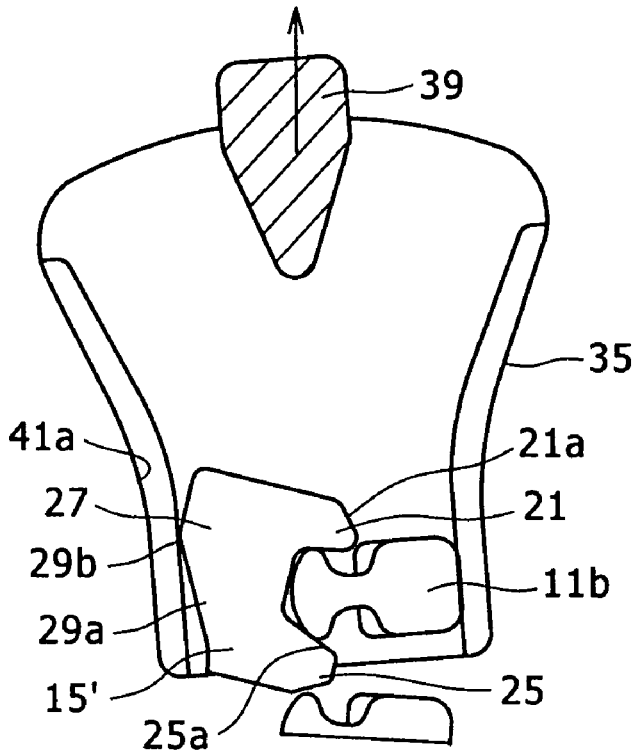

FIGS. 6*a* and 6*b* show a releasable end stop 15 of reduced length. Although it is preferable for the releasing end stop 15 to extend over two coupling elements 11 to facilitate alignment in the slider 35 as shown in the first embodiment, in order to allow the releasing end stop 15 to assume the posture of being in parallel with the longitudinal axis of A-A of the slider 35, it is believed that the invention can be practiced with a shorter length releasing ends stop 15'. The cord 9 and tape 7 will serve to control the orientation of the releasing end stop 15' within the channel 47 of the slider 35 as it rides over the flange 41 and engages with the opposed element 11*b*.

Figure 7:
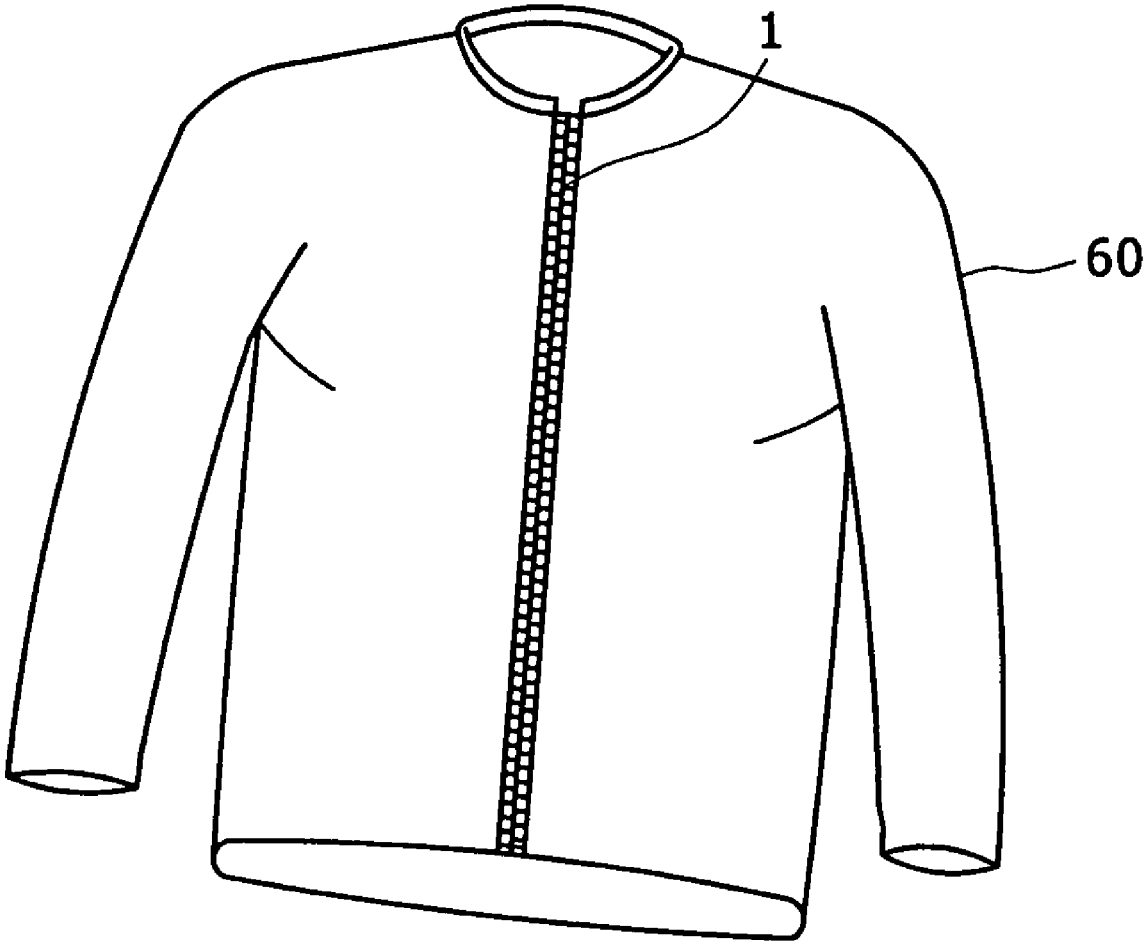
FIG. 7 shows an article comprising the slide fastener of FIG. 1.

FIG. 7 shows a garment 60 comprising the slider fastener 1 embodying the invention. The slide fastener 1 is operated in the conventional manner as described above to do up the coat. If the coat must be opened quickly then the slider 35 of the slide fastener 1 can be pulled forcibly upwards to push past the top end stop 15 and the coupling elements 11 of the slide fastener 1 can be peeled apart quickly to allow the coat to be removed. The slide fastener may be used with other items such as bags, life jackets, or the like, and is particularly useful when an emergency opening facility is required.

CONCLUSION, RAMIFICATIONS, AND SCOPE

According to the present invention, when additional force is applied to the slider, the releasing end stop is rotatable substantially in the plane of the tape to allow movement of the releasing end stop through the slider. Therefore, the releasing end stop can be made of a rigid, hardwearing material to suit the repeated operation of the slide fastener, as the coupling elements. Hence, the likelihood of the releasing end stop being damaged during operation is extremely reduced. The releasing end stop enjoys a longer life span.

Furthermore, it is possible to use the same material for the top end stop as for the coupling elements, so that the manufacturing process will be much simplified.

Various modifications will be apparent to those in the art and this is desired to include all such modifications as fall within the scope of the accompanying claims.

What is claimed is:

1. A slide fastener comprising a pair of first and second stringers each including a tape and a row of coupling elements mounted on a respective longitudinal edge thereof and a slider having flanges defining in part therebetween a bifurcated channel through which the coupling elements pass and adapted to slidably move along the rows of the coupling elements; the first stringer including a releasing end stop adapted to engage with one of the flanges to impede movement of the releasing end stop through the slider; the flanges forming a neck at a rear end of the slider distal of an upper dividing wall, the releasing end stop having a body portion mounted on the tape and including a first side facing the second stringer, a second side opposed to the first side and a shoulder provided on the second side so as to project laterally from the second side for engagement with the one flange of the slider, wherein the releasing end stop is pivotable relative to the an opposed coupling element to allow movement of the releasing end stop through the slider when additional force is applied to the slider.

2. A slide fastener as claimed in claim 1, the shoulder has a shoulder surface formed at the lower end thereof and a sloping outer side surface extending between the shoulder surface and the second side and slanting from the second slide toward the upper end of the body portion, the outer side surface of the shoulder riding along the inner surface of the flange.

3. A slide fastener as claimed in claim 1, wherein the shoulder engages an inner wall of the one of the flanges at a position which is closer to a rear end of the slider than to the dividing wall.

4. A slide fastener as claimed in claim 1, wherein the releasing end stop has a recess for receiving a head of an opposed coupling element of the second stringer when the releasing end stop and the opposed coupling element enter the neck of the slider.

5. A slide fastener as claimed in claim 4, when additional force is applied to the slider and the shoulder moves toward the neck along the flange of the slider, the releasing end stop rotates on the head of the coupling element.

6. A slide fastener as claimed in claim 5, the recess including a first recess adjacent to the lower end of the releasing end stop and a second recess adjacent to the upper end thereof; the first and second recesses being adapted to receive the heads of the coupling elements, respectively, of the second stringer.

7. A slide fastener as claimed in claim 6, wherein when the releasing end stop and the opposed coupling elements are positioned in the region of the neck of the slider, a bottom of the second recess is further from the head of the opposed second coupling element than the bottom of the first recess is from the head of the first opposed coupling element, and wherein the releasable end stop rotates about the head of the first coupling element when additional force is applied to the slider and the shoulder slides down the flange of the slider towards the region of the neck.

8. A slide fastener as claimed in claim 4, 5, or 6, wherein the tape has a cord along its edge, upon which the coupling elements are mounted and the cord is exposed at the bottoms of the recesses formed at a position of the body portion opposed to the shoulder.

9. A slide fastener as claimed in claim 4, the recess is formed between protrusions, the protrusions being tapered at its end to provide sloping engagement surfaces.

10. A slide fastener as claimed in any one of claims 1 and 3-7, wherein a lower end of the releasing end stop has a protrusion which abuts the side wall of the dividing wall of the slider sufficiently to ensure uncoupling of coupling elements adjoining the releasing end stop when the slider is slid down the fastener to open the fastener normally.

* * * * *